US009249618B2

(12) United States Patent
Sevcik et al.

(10) Patent No.: US 9,249,618 B2
(45) Date of Patent: Feb. 2, 2016

(54) DOUBLE PLEAT CELLULAR SHADE WITH VANES

(75) Inventors: Thomas E. Sevcik, Fort Lupton, CO (US); Paul F. Josephson, Firestone, CO (US); Paul G. Swiszcz, Niwot, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 14/240,233

(22) PCT Filed: Aug. 27, 2012

(86) PCT No.: PCT/US2012/052485

§ 371 (c)(1),
(2), (4) Date: Apr. 16, 2014

(87) PCT Pub. No.: WO2013/033005

PCT Pub. Date: Mar. 7, 2013

(65) Prior Publication Data

US 2014/0284004 A1 Sep. 25, 2014

Related U.S. Application Data

(60) Provisional application No. 61/528,061, filed on Aug. 26, 2011, provisional application No. 61/528,068, filed on Aug. 26, 2011.

(51) Int. Cl.

| | |
|---|---|
| ***E06B 3/48*** | (2006.01) |
| ***E06B 9/38*** | (2006.01) |
| ***E06B 9/30*** | (2006.01) |
| *E06B 9/262* | (2006.01) |

(52) U.S. Cl.
CPC . *E06B 9/38* (2013.01); *E06B 9/262* (2013.01); *E06B 9/30* (2013.01); *E06B 2009/2627* (2013.01)

(58) Field of Classification Search
CPC ... E06B 2009/2627; E06B 9/262; E06B 9/38; E06B 9/30
USPC ..... 160/84.04, 84.05, 89
See application file for complete search history.

(56) References Cited

U.S. PATENT DOCUMENTS

| | | | | |
|---|---|---|---|---|
| 4,019,554 A | * | 4/1977 | Rasmussen | 160/84.02 |
| 4,974,656 A | | 12/1990 | Judkins | |
| 5,158,632 A | | 10/1992 | Colson et al. | |
| 5,193,601 A | | 3/1993 | Corey et al. | |
| 5,205,333 A | | 4/1993 | Judkins | |
| 5,313,998 A | * | 5/1994 | Colson et al. | 160/84.02 |
| 5,503,210 A | | 4/1996 | Colson et al. | |

(Continued)

OTHER PUBLICATIONS

PCT International Search Report and Written Opinion dated Oct. 26, 2012, PCT Application No. PCT/US2012/052473, 20 pages.

(Continued)

*Primary Examiner* — Blair M Johnson
(74) *Attorney, Agent, or Firm* — Dorsey & Whitney LLP

(57) ABSTRACT

A covering for an architectural opening is provided. The covering may include a head rail, an end rail, and a cellular panel operably connected between the head rail and the end rail. The cellular panel may include at least one cellular unit. Each cellular unit may include a primary cell having a first side and a second side. In one configuration, the first side has a single crease, and the second crease has three creases. A vane may be operably connected to the primary cell and extend around at least a portion of a side of the primary cell.

22 Claims, 15 Drawing Sheets

(56) References Cited

U.S. PATENT DOCUMENTS

| | | | | |
|---|---|---|---|---|
| 5,620,035 | A * | 4/1997 | Judkins | 160/84.05 |
| 5,974,763 | A | 11/1999 | Colson et al. | |
| D448,594 | S | 10/2001 | Throne | |
| 6,302,181 | B1 | 10/2001 | Rupel | |
| 6,345,486 | B1 | 2/2002 | Colson et al. | |
| 6,354,353 | B1 | 3/2002 | Green et al. | |
| 6,550,519 | B2 | 4/2003 | Green et al. | |
| D501,749 | S | 2/2005 | Gruner | |
| D514,859 | S | 2/2006 | Herhold et al. | |
| 7,191,816 | B2 | 3/2007 | Colson et al. | |
| D605,885 | S | 12/2009 | Judkins | |
| 7,637,301 | B2 | 12/2009 | Forst Randle | |
| D636,204 | S * | 4/2011 | Elinson et al. | D6/575 |
| D663,147 | S | 7/2012 | Cheng | |
| D685,210 | S * | 7/2013 | Josephson et al. | D6/575 |
| D686,022 | S * | 7/2013 | Sevcik | D6/575 |
| 2006/0225846 | A1 * | 10/2006 | Marusak et al. | 160/126 |
| 2007/0074826 | A1 * | 4/2007 | Jelic et al. | 160/84.05 |
| 2008/0286569 | A1 | 11/2008 | Husemann et al. | |
| 2010/0095535 | A1 | 4/2010 | Akins et al. | |
| 2011/0088852 | A1 * | 4/2011 | Hu et al. | 160/84.05 |
| 2013/0133840 | A1 * | 5/2013 | Malkan | 160/84.05 |
| 2013/0180669 | A1 * | 7/2013 | Judkins | 160/84.04 |
| 2014/0168779 | A1 * | 6/2014 | Malkan | 359/614 |
| 2014/0224432 | A1 * | 8/2014 | Josephson et al. | 160/84.04 |
| 2014/0284004 | A1 * | 9/2014 | Sevcik et al. | 160/84.04 |
| 2015/0041072 | A1 * | 2/2015 | Hsu et al. | 160/84.05 |

OTHER PUBLICATIONS

PCT International Search Report and Written Opinion dated Nov. 19, 2012, PCT Application No. PCT/US2012/52485, 17 pages.

PCT International Search Report dated Jan. 2, 2013, PCT Application No. PCT/US2012/052493, 4 pages.

U.S. Appl. No. 29/400,375, filed Aug 26, 2011.

U.S. Appl. No. 29/400,378, filed Aug 26, 2011.

U.S. Appl. No. 14/240,264, filed Aug 27, 2012.

U.S. Appl. No. 14/240,290, filed Aug 27, 2012.

* cited by examiner

DOUBLE PLEAT CELLULAR SHADE WITH VANES

CROSS-REFERENCE TO RELATED APPLICATIONS

This application is the national stage application of International Patent Application No. PCT/US2012/052485 filed Aug. 27, 2012, entitled "Double Pleat Cellular Shade With Vanes", which claims the benefit under 35 U.S.C. 119(e) of U.S. Provisional Application No. 61/528,068, filed Aug. 26, 2011, entitled "Double Pleat Cellular Shade with Vanes," and U.S. Provisional Application No. 61/528,061, filed Aug. 26, 2011, and entitled "Double Pleat Cellular Shade Element," which are hereby incorporated by reference herein in their entireties. This application also is related to co-pending U.S. Design Patent Application No. 29/400,378, now U.S. Design Patent No. D686,022, filed Aug. 26, 2011, and entitled "Cellular Shade Component."

FIELD

The present invention relates generally to coverings for architectural openings and more specifically to cellular coverings for architectural openings.

BACKGROUND

Coverings for architectural openings, such as windows, doors, archways, and the like, have taken numerous forms for many years with some of these coverings being retractable in nature so as to be movable between an extended position across the opening and a retracted position adjacent one or more sides of the opening.

More recently, retractable coverings have been made in a cellular format. The cells in such coverings are typically elongated tubes or cells that extend laterally across an opening. When the covering is open and extended across a window opening, the cells are themselves expanded, but when the covering is retracted, the cells collapse so that each cell is stacked with the adjacent cell, and collectively stacked together in a small space.

SUMMARY

Examples of the disclosure may include a covering for an architectural opening. The covering may include a head rail, an end rail or bottom rail, and a cellular panel operably connected to and extending between the head rail and the end rail. The cellular panel includes at least one cellular unit, and each cellular unit includes a primary cell and a vane. The primary cell has a first side and a second side, each of which may have at least one crease. In one example, the first side has a single or first crease, and the second side has three creases, particularly a second crease, a third crease, and a fourth crease.

Other examples of the disclosure may include a method of creating a cellular panel. The method may include folding at least one strip of material to create at least one primary cell. Once the primary cell is created, the method may include creasing the at least one strip of material at four spatially separate locations. The method may further include creating at least one vane, and adhering the at least one vane to the at least one primary cell.

This summary of the disclosure is given to aid understanding, and one of skill in the art will understand that each of the various aspects and features of the disclosure may advantageously be used separately in some instances, or in combination with other aspects and features of the disclosure in other instances.

DETAILED DESCRIPTION

Overview

Figure 1:
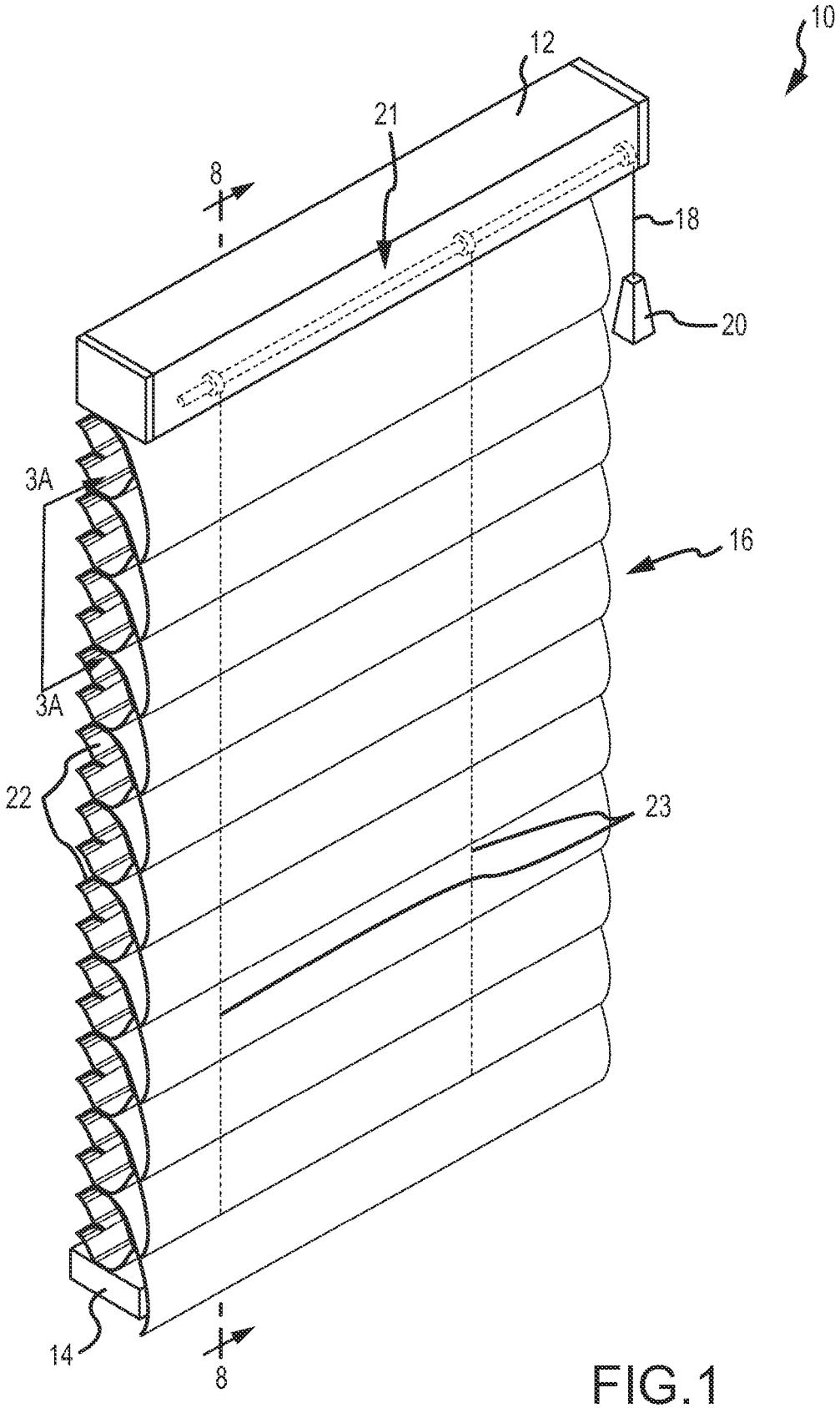
FIG. 1 is an isometric view of a covering for an architectural opening.

A cellular covering typically includes a plurality of elongated vertically aligned, laterally extending, transversely collapsible cells which are longitudinally adhered to upper and lower adjacent cells to form a vertical stack of cells. The transverse cross-section of each cell can take numerous forms such as hexagonal, octagonal, or variations thereof. While such coverings utilizing transversely collapsible cells are typically oriented so the cells extend laterally or horizontally, panels of such material can also be oriented so the cells extend vertically or at an angle between horizontal or vertical.

In some embodiments herein, a cellular shade having a double pleated or creased cell and a vane operably connected to the cell is disclosed. The cellular shade or panel may include at least two cellular units longitudinally aligned, where each cellular unit includes a primary or inner cell and a vane attached to each primary cell.

The primary cell includes a first side and a second side. The first side of the cell may have a single crease or pleat and the second side of the cell may have multiple creases or pleats, thus as the cellular unit is collapsed the first side of the cell may bend or fold at a single location or line and the second side of the cell may bend at multiple locations. In some examples, one crease on the second side of the cell may be an inner crease having an apex directed towards the inner volume of the cell. This cell configuration allows for the cellular panel to have a reduced depth for a similar drop-length as other cell constructions. This allows for the cellular panel to fit into smaller depth architectural openings, e.g., low-depth window frames, while still providing for a larger drop and cellular length appearance. For example, a first side of a cell may appear to have a large height dimension, but the cell may fit into an architectural opening with a relatively low depth.

In addition to the primary cell, each cellular unit may also include a vane. The vane may be attached to an upper outer surface of the primary cell and may extend outwards and downward relative to the attachment point, so as to at least partially cover the first side of the primary cell. When in an extended position, each vane may rest on or be adjacent to a top portion of a following vane, such that in the extended position the vanes themselves may form pseudo-cells. The pseudo-cells may be defined by a top vane, a bottom vane, and the primary cell to which the top vane is attached. The pseudo-cells may provide an additional layer of insulation, without requiring multiple additional material layers to create the pseudo-cell. Furthermore, the pseudo-cells may be positioned on the side of the cellular panel that faces towards the room (e.g., away from the architectural opening). In these instances, the vane may be a more expensive or better quality material (i.e., woven fabric with rich color and texture) which may be the only material visible by the user. Because the outer materials forming the primary cell may be less expensive since they are hidden from the user by the vane, this structure may be generally less expensive than another comparative cellular panel including two separate rows of cells. Also, the vane may provide the appearance of a cell having a larger height without breaks, which is believed by some to provide a more aesthetically pleasing result.

Each vane may be formed from a single piece or strip of material that may be folded and attached to itself at an uneven length. In other words, the vane may have a tab that is a single layer of material, whereas the rest of the vane may be two layers of material. To form the vane, the unfolded strip of material is positioned on a form, such as a curved surface. The vane is then folded at a particular location back upwards to create the tab. The fold location is then creased, and the folded portion of the material is attached to a surface of the non-folded material with adhesive. The entire vane may then be heated or otherwise processed to set the crease at the fold line and set the material to the shape of the form.

Description Of Figures

Figure 2:
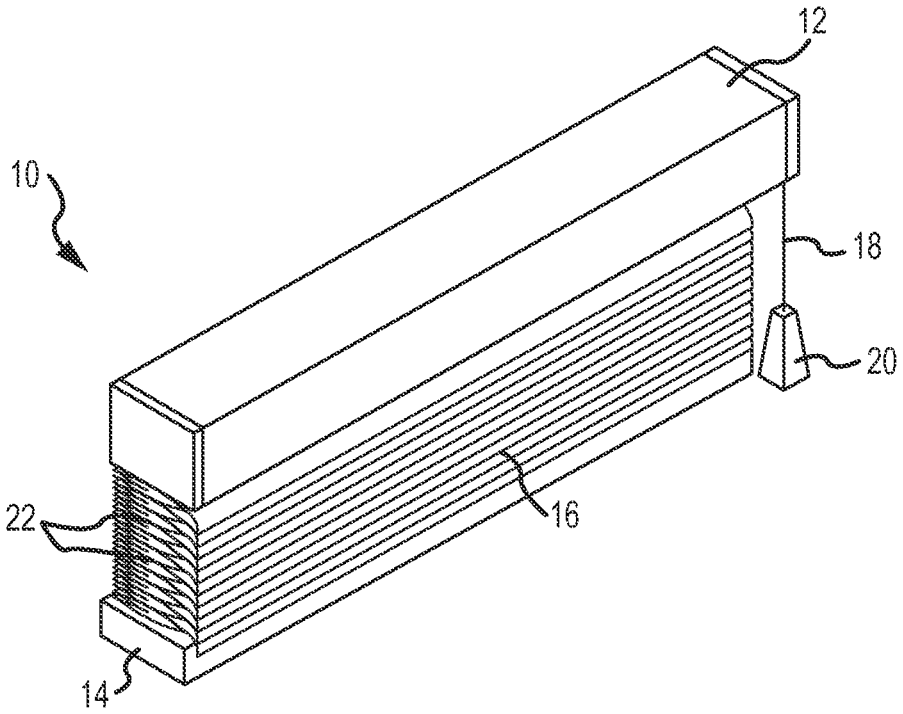
FIG. 2 is an isometric view of the covering of FIG. 1 in a retracted position.

FIG. 1 is an isometric view of a covering 10 for an architectural opening in an extended position. The covering 10 includes a plurality of elongated vertically aligned, laterally extending, transversely collapsible cellular units 22 which are longitudinally adhered to adjacent cellular units 22 to form a vertical stack of cellular units 22. The covering 10 may include at least two cellular units 22 longitudinally aligned, with each cellular unit having a primary or inner cell and a vane. In some embodiments, each cellular unit 22 has a double pleated or creased primary or inner cell and a single vane operably connected to the primary cell. FIG. 2 is an isometric view of the covering 10 in a retracted or stacked position with the cellular units 22 collapsed. The covering 10 may include a head rail 12, a bottom or end rail 14, and a flexible cellular panel 16 made up of a plurality of cellular units 22 interconnecting the head rail 12 and the bottom rail 14. The covering 10 may be moved from the extended position illustrated in FIG. 1 to the retracted position illustrated in FIG. 2 by operating a control cord 18 having a tassel 20 located on a free end of the control cord 18. The control cord 18 may be connected to a lift mechanism 21, which may include a lift cord 23, a drive mechanism, a pulley, a roller, and/or other suitable features known in the art. The lift mechanism 21 is anchored in the head rail 12 and may extend through the panel 16 from the head rail 12 to the bottom rail 14 and is operative to selectively lift the bottom rail 14 towards the head rail 12. To extend the covering 10, the tassel 20 may rise, providing extra length to the lift mechanism 21, and the bottom rail 14 (through gravity) may drop. In other examples, the covering 10 may include alternate control and/or lift mechanisms, such as an automatic or motorized system, pulley system, and so on. The automatic system may be electrical or spring driven, for example.

Referring to FIG. 1, the panel 16 may include a plurality of cellular units 22 or rows. Each cellular unit 22 may extend horizontally or laterally across the width of the panel 16 and may be vertically aligned with each other cellular unit 22. Each cellular unit 22 may be operably connected along its length to immediately adjacent upper and lower cellular units 22 (described in more detail below). Additionally, each cellular unit 22 may be transversely collapsible, such that as the covering 10 is retracted, the cellular units 22 may reduce in height and stack together. For example, the cross-sectional area of each cellular unit 22 taken at a right angle with respect to the length of the panel 16 collapses in a desired way to allow stacking.

Figure 3A:
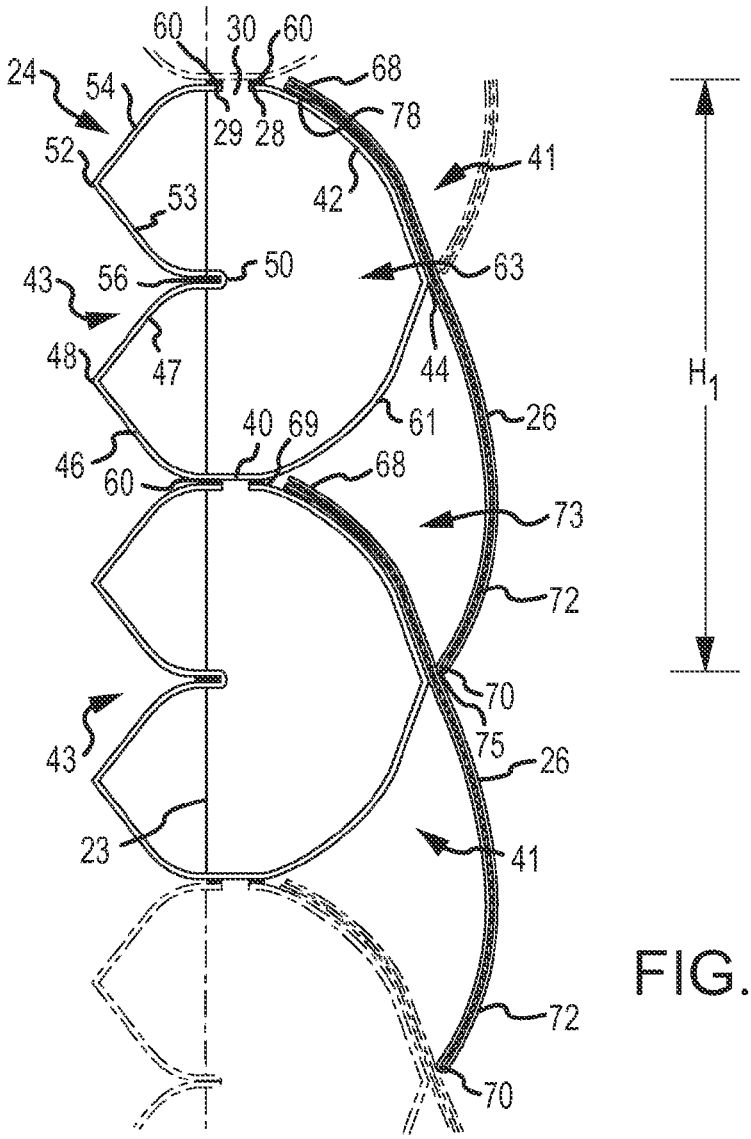
FIG. 3A is an enlarged side elevation view taken along the line 3A-3A as shown in FIG. 1.
Figure 3B:
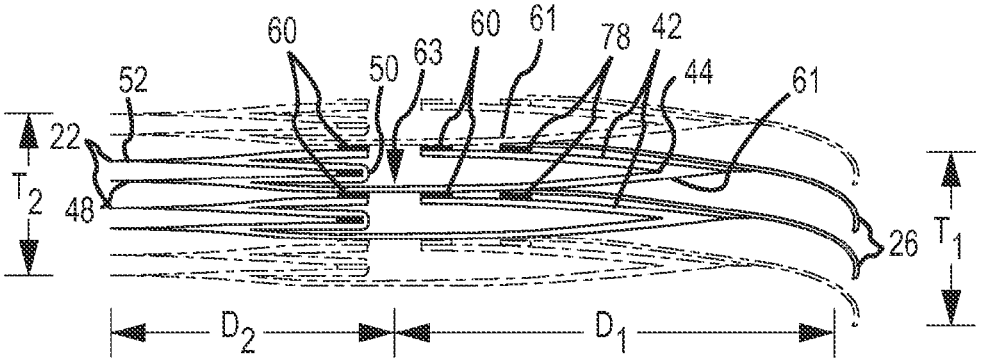
FIG. 3B is a side elevation view of the two cellular units of FIG. 3A in the retracted position of FIG. 2.
Figure 3C:
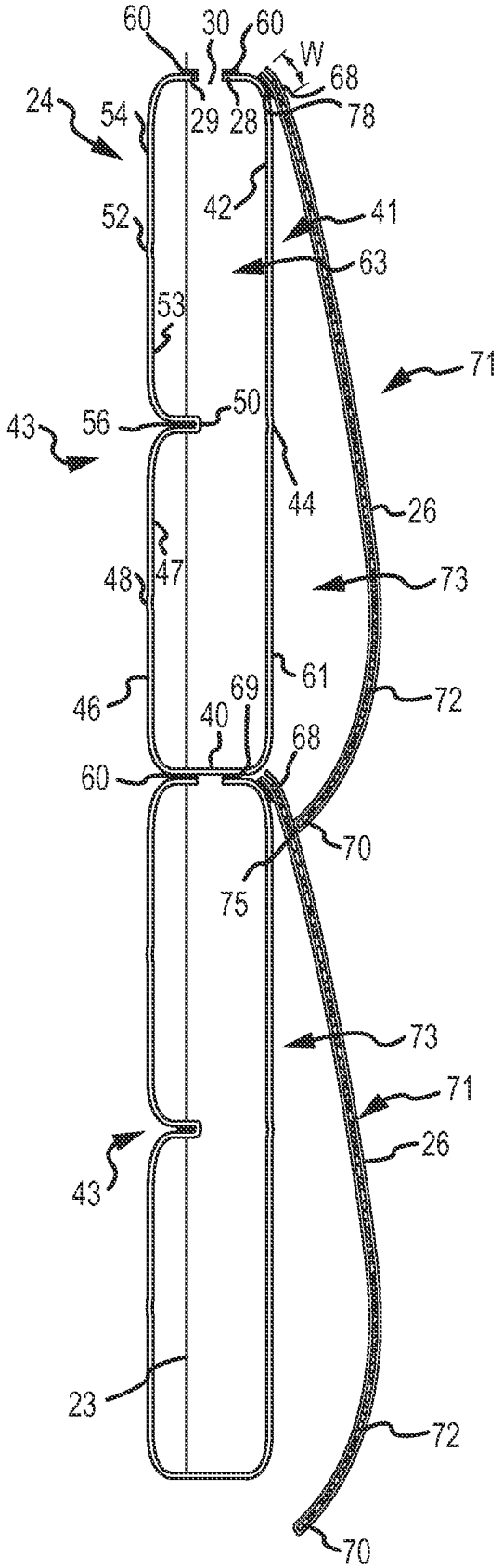
FIG. 3C is a side elevation view of the two cellular units of FIG. 3A in a fully expanded position.

FIG. 3A is a side elevation view of the panel 16 in a partially extended position. FIG. 3B is a side elevation view of the panel 16 in a retracted position. FIG. 3C is a side elevation view of the panel 16 in a fully extended position. Each cellular unit 22 may include a primary cell 24 and a vane 26.

The Primary Cell

Referring to FIGS. 3A-3C, the primary or inner cell 24 may be formed from a strip of material having two longitudinal edges 28, 29. The material of the primary cell 24 may be woven, non-woven, knit, fabric, plastic sheet, manmade, natural, a combination of materials, a laminate, and so on. The material of the primary cell 24 may be blackout, opaque, clear, or have substantially any level of light transmissivity or translucence.

The longitudinal edges 28, 29 are secured together, either overlapping, adjacent one another, or spaced apart, to form a top 30 of the primary cell 24. In one example, the longitudinal edges 28, 29 may be secured via lines of adhesive 60 positioned on an outer surface of each edge 28, 29 which may secure the edges 28, 29 to an outer surface of a bottom 40 of an adjacent primary cell 24. However, in other examples, the longitudinal edges 28, 29 may be connected to adjacent cellular units 22 in other manners (e.g., fasteners). In examples where the two longitudinal edges 28, 29 may be spaced apart but adjacent one another, a top 30 of the primary cell 24 may be formed by the combination of the longitudinal edges 28, 29 and the outer surface of the bottom 40 of an adjacent primary cell. Alternatively, the longitudinal edges 28, 29 may form the bottom 40 of the primary cell 24. The top 30 and/or bottom 40 of the primary cell 24 may be connected to an adjacent cell via lines of adhesive 60 positioned on an outer surface of the top 30 and/or bottom 40. Although not depicted, other suitable methods of connection, such as stitching, may be used. Generally, the top 30 and the bottom 40 of the primary cell 24 are spatially or vertically separated from each other to define a height of the cell 24.

In addition to the top 30 and the bottom 40, each primary cell 24 includes two spatially or laterally separated sides, generally referred to as a first side 41 and a second side 43 herein for convenience purposes, that extend between the top 30 and the bottom 40 of the cell 24. The first side 41 is positioned so that it generally faces towards the room of the architectural opening (although it may be covered by the material forming the secondary cell 26). The second side 43 opposes the first side 41 and generally faces the road-side of the architectural opening.

Figure 4:
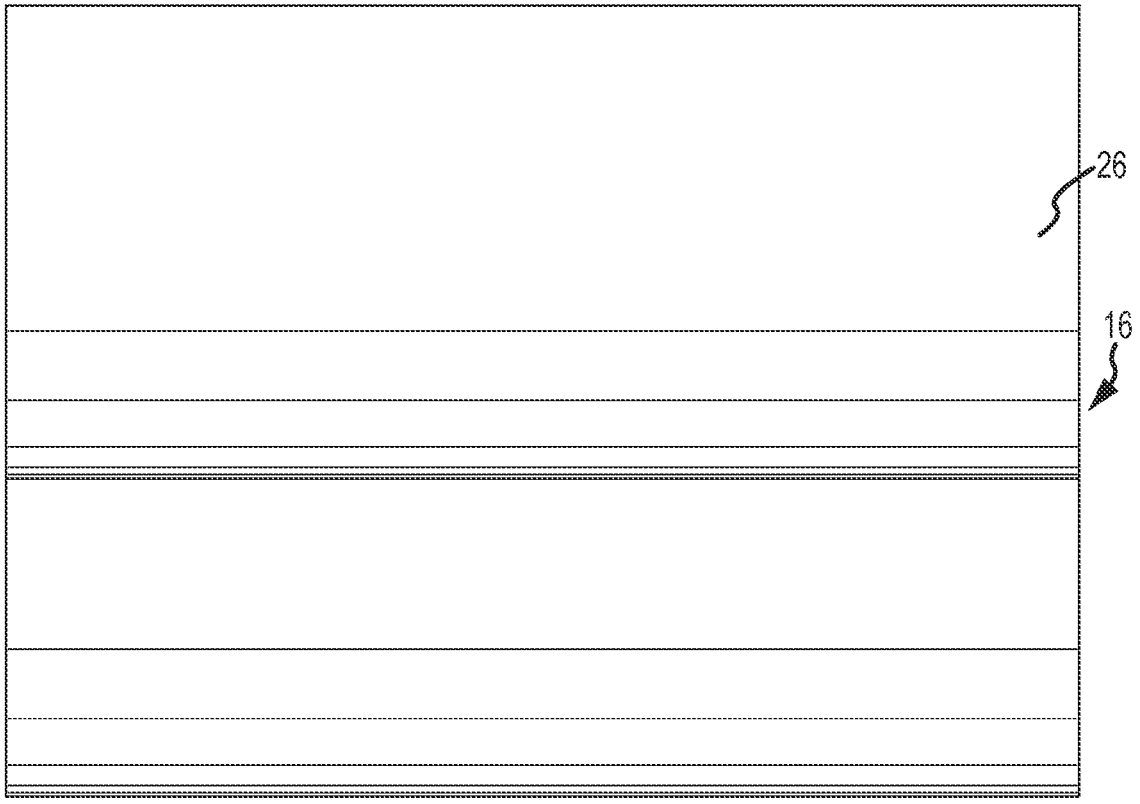
FIG. 4 is a front elevation view of the two cellular units of FIG. 3A.
Figure 5:
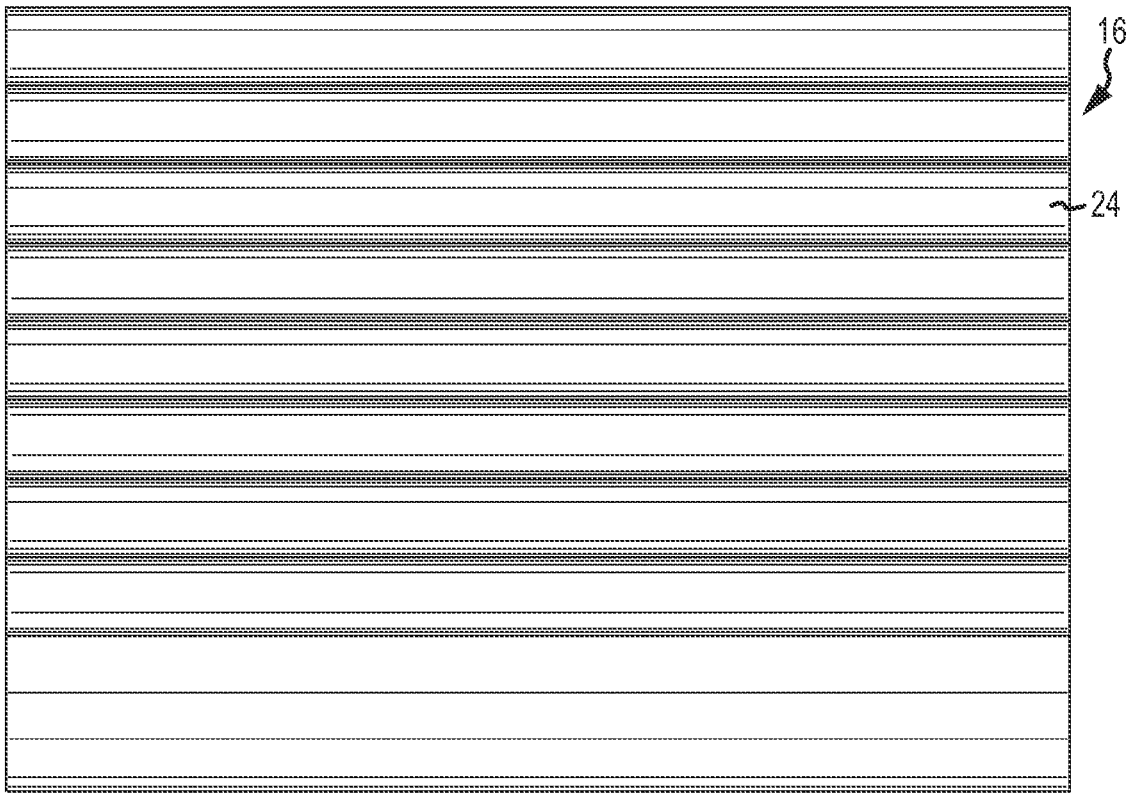
FIG. 5 is a rear elevation view of the two cellular units of FIG. 3A.

The first side 41 of the primary cell 24 is defined by an upper sidewall portion 42 and a lower sidewall portion 61 divided by an outer pleat or crease 44, which for convenience purposes is generally referred to as a first crease 44 in this disclosure. The first side 41 generally resembles a right curly brace or bracket that opens towards the inner volume 63 of the primary cell 24. The first crease 44 is an outer crease in that the apex of the first crease 44 is directed outward and away from an inner volume 63 of the primary cell 24. The first crease 44 extends along the entire length of the primary cell 24. The first crease 44 acts as a bend or fold point for the primary cell 24 and when the cellular panel 16 is retracted, the primary cell 24 collapses at the crease 44. For example, as shown in FIG. 4, when the cellular units 22 are collapsed, the primary cell 24 bends at the first crease 44. This allows the primary cell 24 to collapse at a predicted location, as well as provide for uniform extending and retracting of the cellular panel 16. The first crease 44 may be located at approximately a midpoint of the height of the primary cell 24 so that the upper sidewall portion 42 and the lower sidewall portion 61 have equal heights.

The upper sidewall portion 42 of the primary cell 24 extends between the top 30 of the cell 24 and the first crease 44. The upper sidewall portion 42 may have a generally arcuate or curved shape, may be generally linear, or both. The upper sidewall portion 42 may include concave segments, convex segments, or both. For example, relative to an inner volume 63 of the primary cell 24, the upper sidewall portion 42 shown in FIG. 3A includes a concave inward segment extending downward and outward from the top 30 of the cell 24. The concave inward segment is positioned above a convex inward segment that terminates at first crease 44. If the upper sidewall portion 42 includes altering curvatures or concavity, an inflection point between the curvature or concavity changes may be positioned at various heights between the top 30 and the first crease 44 of the cell 24, including a midpoint of the height of the upper sidewall portion 42. Additionally or alternatively, a generally linear section may be positioned integrally between, above, and/or below the generally arcuate or curved segments. The upper sidewall portion 42 transitions into the first crease 44, which delineates the lower sidewall portion 61 from the upper sidewall portion 42.

The lower sidewall portion 61 of the primary cell 24 extends between the first crease 44 and the bottom 40 of the cell 24. Similar to the upper sidewall portion 42, the lower sidewall portion 61 may have a generally arcuate or curved shape, may be generally linear, or both. In addition, the lower sidewall portion 61 may include concave segments, convex segments, or both. For example, relative to an inner volume 63 of the primary cell 24, the lower sidewall portion 61 shown in FIG. 3A includes a convex inward segment extending downward and inward from the first crease 44 of the cell 24. The convex inward segment is positioned above a concave inward segment that terminates at the bottom 40 of the cell 24. If the lower sidewall portion 61 includes altering curvatures or concavity, an inflection point between the curvature or concavity changes may be positioned at various heights between the bottom 40 and the first crease 44, including a midpoint of the height of the lower sidewall portion 61. Additionally or alternatively, a generally linear section may be positioned integrally between, above, and/or below the generally arcuate or curved segments.

The second side 43 of the primary cell 24 is defined by a plurality of sidewall portions divided by a plurality of creases. Although various numbers of sidewall portions and creases are contemplated, the second side 43 shown in FIG. 3A includes four sidewall portions divided by three creases. For convenience purposes, the four sidewall portions are referred to herein as a first upper sidewall portion 54, a second upper sidewall portion 53, a first lower sidewall portion 47, and a second lower sidewall portion 46. In addition, for convenience purposes, the three creases are referred to herein as a second crease 52, a third crease 50, and a fourth crease 48. The second crease 52, the third crease 50, and the fourth crease 48 extend along the entire length of the primary cell 24. The creases 52, 50, 48 each act as bend or fold point for the primary cell 24 and when the cellular panel 16 is retracted, the primary cell 24 collapses at each of the creases 52, 50, 48. For example, as shown in FIG. 3B, when the cellular units 22 are collapsed, the primary cell 24 bends at the second crease 52, the third crease 50, and the fourth crease 48. This allows the primary cell 24 to collapse at predicted locations, as well as provide for uniform extending and retracting of the cellular panel 16.

The first upper sidewall portion 54 and the second upper sidewall portion 53 are divided by the second crease 52, which is an outer crease in that the apex of the crease 52 is directed outward and away from the inner volume 63 of the primary cell 24. The second crease 52 is located at a cell height location above the first crease 44 on the first side 41 of the primary cell 24. In other words, the length of the first sidewall 42 prior to the first crease 44 may be longer than the length of the upper second sidewall 54 prior to the second crease 52. The second crease 52 may be located at approximately a midpoint of the aggregate height of the first and second upper sidewall portions 54, 53 so that the upper sidewall portions 54, 53 have equal heights. In other words, the second crease 52 may be located vertically equidistant between the top 30 of the cell 24 and the third crease 50. Additionally or alternatively, the combined height of the first and second upper sidewall portions 54, 53 may be coextensive in height with the upper sidewall portion 42 of the first side 41 of the primary cell 24. Thus, in some implementations, the second crease 52 may be vertically positioned at a midpoint height of the upper sidewall portion 42, while being laterally separated from the sidewall portion 42 by the inner volume 63 of the primary cell 24. In other words, the second crease 52 may be located vertically equidistant between the top 30 of the cell 24 and the first crease 44.

The first upper sidewall portion 54 of the second side 43 of the primary cell 24 extends between the top 30 of the cell 24 and the second crease 52. The first upper sidewall portion 54 may have a generally arcuate or curved shape, may be generally linear, or both. For example, the first upper sidewall portion 54 shown in FIG. 3A includes an arcuate or curved segment extending downward and outward from the top 30 of the cell 24. The arcuate or curved segment generally forms a concave inward shape relative to the inner volume 63 of the primary cell 24. A lower end of the arcuate or curved segment transitions into a linear segment that terminates at the second crease 52. From the top 30 of the primary cell 24, the first upper sidewall portion 54 and the upper sidewall portion 42 diverge from each other so that the inner volume 63 of the primary cell 24 increases in depth from the top 30 of the cell 24 to the second crease 52, which delineates the first upper sidewall portion 54 from the second upper sidewall portion 53.

The second upper sidewall portion 53 of the second side 43 of the primary cell 24 extends between the second crease 52 and the third crease 50. Similar to the first upper sidewall portion 54, the second upper sidewall portion 53 may have a generally arcuate or curved shape, may be generally linear, or both. For example, the second upper sidewall portion 53 shown in FIG. 3A includes a linear segment extending downward and inward from the second crease 52. A lower end of the linear segment transitions into an arcuate or curved segment that terminates at the third crease 50. The arcuate or curved segment generally forms a concave inward shape relative to the inner volume 63 of the primary cell 24. From a cell height location coextensive with the height of the second crease 52, the second upper sidewall portion 53 and the upper sidewall portion 42 both extend downward toward a room side of the covering 10. The second upper sidewall portion 53 generally extends downward at a less severe curvature or slope than the upper sidewall portion 42 so that the inner volume 63 of the primary cell 24 decreases in depth from the second crease 52 to the third crease 50.

The third crease 50 divides the second upper sidewall portion 53 and the first lower sidewall portion 47. The third crease 50 is an inner crease in that the apex of the third crease 50 is directed inward toward the inner volume 63 of the primary cell 24. The third crease 50 may be located at approximately a midpoint of the height of the primary cell 24 so that the combined height of the first and second upper sidewall portions 54, 53 is approximately equal to the combined height of the first and second lower sidewall portions 47, 46. In other words, the third crease 50 may be located vertically equidistant between the top 30 and the bottom 40 of the cell 24. Additionally or alternatively, the third crease 50 may be coextensive in height with the first crease 44, while being laterally separated from the first crease 44. In some implementations, the first crease 44 and the third crease 50 are vertically aligned or coplanar so that a horizontal plane passing through the creases 44, 50 divides the inner volume 63 of the primary cell 24 into an upper and lower cavity having equal volumes. The third crease 50 may be positioned so that the crease 50 is approximately laterally aligned with the longitudinal edge 28 of the second side 43 of the primary cell 24. Adhesive 56 may be associated with the third crease 50 to assist in maintaining the shape of the second side 43 of the primary cell 24 when the cellular panel 16 is extended. For example, the adhesive 56 may substantially prevent the second and fourth creases 52, 48 from stretching, as the adhesive 56 maintains the shape of the third crease 50. The adhesive 56 may also increase the resiliency of the primary cell 24. Although the second upper sidewall portion 53 and the first lower sidewall portion 47 are depicted as integrally connected at the third crease 50, the sidewall portions 53, 47 may be formed as separate pieces and operably connected together at the third crease 50 location by the adhesive 56. Additionally or alternatively, other suitable fastening methods, such as stitching, may be used.

The first lower sidewall portion 47 and the second lower sidewall portion 46 are divided by the fourth crease 48, which is an outer crease in that the apex of the crease 48 is directed outward and away from the inner volume 63 of the primary cell 24. The fourth crease 48 may be located at approximately a midpoint of the aggregate height of the first and second lower sidewall portions 47, 46 so that the lower sidewall portions 47, 46 have equal heights. In other words, the fourth crease 48 may be located vertically equidistant between the third crease 50 and the bottom 40 of the cell 24. Additionally or alternatively, the combined height of the first and second lower sidewall portions 47, 46 may be coextensive in height with the lower sidewall portion 61 of the first side 41 of the primary cell 24. Thus, in some implementations, the fourth crease 48 may be vertically positioned at a midpoint height of the lower sidewall portion 61 while being laterally separated from the sidewall portion 61 by the inner volume 63 of the primary cell 24. In other words, the fourth crease 48 may be located vertically equidistant between the first crease 44 and the bottom 40 of the cell 24.

The first lower sidewall portion 47 of the second side 43 of the primary cell 24 extends between the third crease 50 and the fourth crease 48. The first lower sidewall portion 47 may have a generally arcuate or curved shape, may be generally linear, or both. For example, the first upper sidewall portion 47 shown in FIG. 3A includes an arcuate or curved segment extending downward and outward from the third crease 50 of the cell 24. The arcuate or curved segment generally forms a concave inward shape relative to the inner volume 63 of the primary cell 24. A lower end of the arcuate or curved segment transitions into a linear segment that terminates at the fourth crease 48. From the third crease 50 of the primary cell 24, the first lower sidewall portion 47 and the lower sidewall portion 61 both extend downward toward a road side of the covering 10. The first lower sidewall portion 47 generally extends downward at a less severe curvature or slope than the lower sidewall portion 61 so that the inner volume 63 of the primary cell 24 increases in depth from the third crease 50 to the fourth crease 48, which delineates the first lower sidewall portion 47 from the second lower sidewall portion 46.

The second lower sidewall portion 46 of the second side 43 of the primary cell 24 extends between the fourth crease 48 and the bottom 40 of the cell 24. Similar to the first lower sidewall portion 54, the second lower sidewall portion 46 may have a generally arcuate or curved shape, may be generally linear, or both. For example, the second lower sidewall portion 46 shown in FIG. 3A includes a linear segment extending downward and inward from the fourth crease 48. A lower end of the linear segment transitions into an arcuate or curved segment that terminates at the bottom 40 of the primary cell 24. The arcuate or curved segment generally forms a concave inward shape relative to the inner volume 63 of the primary cell 24. From a cell height location coextensive with the height of the fourth crease 48, the second lower sidewall portion 46 and the lower sidewall portion 61 converge toward each other so that the inner volume 63 of the primary cell 24 decreases in depth from the fourth crease 48 to the bottom 40 of the cell 24. Thus, in one implementation, as illustrated in FIG. 3, the primary cell 24, when extended, may increase in depth from a top 30 of the cell 24 to a second crease 52, may decrease in depth from the second crease 52 to a third crease 50, may increase in depth from the third crease 50 to a fourth crease 48, and may decrease in depth from the fourth crease 48 to a bottom 40 of the cell 24.

In one example, the first upper sidewall portion 54 and the second upper sidewall portion 53 may form a "V" or "U" shape depending on the angle of the sidewall portions 54, 53 as they extend away from the second crease 52. The apex or tip of the "V" or the bottom of the "U" is directed outward, away from the cell 24. Similarly, the first lower sidewall portion 47 and the second lower sidewall portion 46 may form a "V" or "U" shape, and the apex or tip of the "V" or the bottom of the "U" may be directed outward, away from the cell 24. Thus, the second side 43 may generally resemble a "W" shape, with the bottom tips of the "W" being the second crease 52 and the fourth crease 48. The bottom tips of the "W"

may point towards a road side of the covering 10. It should be noted that in some implementations, the angles of the sidewall portions 46, 47, 53, 54 transitioning into the creases 48, 50, 52 may be significantly increased from the retracted position of the cellular panel 16 to the extended position of the cellular panel 16. Thus, the "W" or "V" shapes may be altered based on the particular position of the cellular panel 16. Furthermore, in some instances, the second sidewalls 46, 47, 53, 54 may have a curved or arcuate shape, and thus may form different shapes transitioning between each crease 48, 50, 52.

As explained above relative to FIG. 3A, in one implementation the primary cell 24 has four creases, the first crease 44 on the first side 41 and the second crease 52, the third crease 50, and the fourth crease 48 located on the second side 43. The first crease 44, the second crease 52 and the fourth crease 48 are outer creases in that the apex of each crease is directed outward and away from an inner portion of the primary cell 24. On the other hand, the third crease 50 is an inner crease in that its apex is directed towards an inner portion of the primary cell 24. Each of the creases 44, 48, 50, 52 act as bending or folding points for the primary cell 24. As described above with respect to the first crease 44, the creases 44, 48, 50, 52 allow the primary cell 24 to collapse at the particular location, as well as maintain a resiliency when the cellular panel 16 is extended. The apexes of the first and third creases 44, 50 both point towards a room side of the covering 10, whereas the apexes of the second and fourth creases 52, 48 both point towards a road side of the covering 10. In one implementation, the third crease 50 is generally aligned with the first crease 44, and the second and fourth creases 52, 48 split the height of the primary cell 24 above and below the first crease 44, respectively.

Furthermore, the third or inner crease 50 provides an additional bend point for the primary cell 24, and in the retracted position (FIG. 3B) allows for the second upper sidewall portion 53 to rest adjacent the first lower sidewall portion 47. The third crease 50 provides for the second side 43 of the primary cell 24 to have approximately the same amount of material as the first side 41, but have a shorter depth than the first side 41 when folded. Referring briefly to FIG. 4, in these examples, the first side 41 may have a depth D1 (as measured from the two longitudinal edges 28, 29) that is approximately double a depth D2 of the second side 43. In this manner, the cellular panel 16 may be positioned in low-depth architectural openings.

With reference to FIGS. 3A and 3B, the second side 43 of the primary cell 24 has approximately the same height of the first side 41 when the cellular panel 16 is extended. Additionally, the stacked or retracted height or thickness T1 of the first side 41 may be approximately the same as the stacked height or thickness T2 of the second side 43.

Although only the third crease 50 is indicated as being held in place via adhesive 56, in other implementations other creases may also be held in place via adhesive. This may allow the outer creases 44, 48, 52 to retain their structure and shape when the cellular panel 16 is extended. However, in other implementations, only the inner crease 50 may be secured via adhesive 56 as the drop of the primary cell 24 may be affected by the inner crease 50 because too much adhesive 56 at the inner crease 50 restricts the crease 50 from fully expanding when dropped or extended.

The "W" shape or the double pleated shape of the primary cell 24 due to the creases 44, 48, 50, 52 allows for the primary cell 24 to have an increased drop ratio. The drop ratio may be determined by the length of the primary cell 24 (or drop) divided by the width of the strip of material used to form the primary cell 24. In some examples, the drop ratio may range from 0.20 to 0.30 depending on various cell widths and so on.

In a specific example, the drop of the primary cell 24 may be approximately 3.25 inches while the perimeter of the primary cell 24, and thus the overall length or width of the strip of material forming the primary cell 24, may be approximately 11.812 inches. In this example, the drop ratio may be approximately 0.275. This drop ratio may be increased as compared to a similar cellular covering having only a single pleat or crease on each side. The better drop ratio may allow the panel 16 to be manufactured using less fabric to cover the same depth of an architectural opening as well as the same length of the architectural opening.

With reference to FIG. 3C, two cellular units 22 are depicted in a fully expanded or extended position. In this position, each cellular unit 22 is vertically elongated and laterally compressed as compared to the partially extended cellular units 22 depicted in FIG. 3A. As shown in FIG. 3C, the outer creases 44, 48, 52 of the primary cell 24 may be substantially non-existent. In other words, when in a fully extended position, the outer creases 44, 48, 52 may disappear or not substantially protrude from the first or second side 41, 43 of the primary cell 24. As such, the first side 41 of each primary cell 24 may be substantially linear and extend substantially vertically between the top 30 and the bottom 40 of the cell 24. Similarly, the upper sidewalls 53, 54 and the lower sidewalls 46, 47 of the second side 43 of each primary cell 24 may be substantially linear. The upper sidewalls 53, 54 may extend substantially vertically between the top 40 and the third crease 50 of the cell 24, and the lower sidewalls 46, 47 may extend substantially vertically between the third crease 50 and the bottom 40 of the cell 24. The third crease 50 generally maintains its shape at least in part due to the adhesive 56, which may assist in maintaining the shape of the second side 43 of the primary cell 24 when the cellular panel 16 is retracted and stacked from the fully extended position. In other words, the inner crease 50 and the adhesive 56 may bias the creases 48, 52 outward as a result of the arcuate transition between the inner crease 50 and the second upper and first lower sidewall portions 53, 47 biasing the creases 48, 52 outward. As shown, when in the fully extended position, the first side 41 may be approximately parallel to the upper sidewalls 53, 54 and the lower sidewalls 46, 47.

In some implementations, the lift cord 23, which may be integrally connected to the control cord 23, may be operably connected to the cellular unit 22 via the primary cell 24. For example, the lift cord 23 may be threaded through an aperture 49 in the adhesive 60 operably connecting adjacent cellular units 22 and through an aperture 49 in the adhesive 56 positioned within the inner crease 50. In this manner, the lift cord 23 can stack and extend the cellular unit 22, and the adhesive 56, 60 may be more rigid than the material of the primary cell 24. Thus, the lift cord 23 may be less likely to tear or rip through the cellular unit 22 if the panel 16 was to be pulled substantially orthogonally to a longitudinal axis of the lift cord 23 (e.g., if the panel 16 covers an open window and a wind gust pulls the panel 16 in a particular direction). It should be noted that, although it may be advantageous to place the lift cord 23 through an aperture 49 in the adhesive 56, in some implementations the lift cord 23 does not extend through the adhesive 56. In some implementations, the lift cord 23 is co-linear with a centerline of the cellular unit 22 extending through the top 30 and the bottom 40 of the cell 24. In these implementations, an aperture 49 associated with the third crease 50 of each cell 24 may be co-linear with the centerline so that the lift cord 23 passes through the third crease 50 along the centerline of the cellular unit 22. Additionally or alternatively, the aperture 49 associated with the longitudinal edge 28 or 29 of the top 30 of the cell 24 may be co-linear with the centerline.

The Vane

Referring to FIG. 3A and FIG. 4, each cellular unit 22 may also include the vane 26. The vane 26 is elongated and defines a top edge 68 and a bottom edge 70, the distance between the top edge 68 and the bottom edge 70 defining a height H1 of the vane. The vane 26 may have a curved shape in the height dimension. In some instances, the vane 26 is connected to the primary cell 24 adjacent to the adhesive 60 connecting each cellular unit 22 to the next cellular unit 22. In other examples, the vane 26 may be connected lower on the front face of the first sidewall 42 than the adhesive 60.

The vane 26 has at least a partially curved shape so that from its line or area of connection to the primary cell 24 it extends outwards and at least partially wraps around to cover the first side 41 of the primary cell 24. In some examples, the vane 26 may at least partially cover the first side 41 (including the first crease 44), thus hiding the first side 41 from view. In these examples, the primary cell 24 may be a first material and the vane 26 may be a second material. Thus, the material forming the primary cell 24 may be a lower quality, less aesthetically pleasing, or a cheaper material than the vane 26, as the material of the primary cell 24 may be hidden. The vane 26 may be made of expensive material, such as but not limited to, rich, texturized, or embossed fabric, as the vane 26 substantially covers the primary cell 24.

Furthermore, in examples where the primary cell 24 may be a blackout material or may include a blackout layer or be a dark color, the vane 26 may reduce a potential color distortion. For example, if the primary cell 24 includes a blackout layer on its inner surface on sidewalls 45, 47, 53, 54, the first outer sidewall 42, 61 (if a lighter color) may appear grey or discolored due to the black or dark layer showing through. However, when the vane 26 is placed in front the outer sidewalls 42, 61 only the desired color of the vane 26 may be visible.

The vane 26 is similar to the primary cell 24 in that it may be formed of a single strip of material. The material for the vane 26 may be substantially any material, such as but not limited to, woven, non-woven, knit, plastic, or other materials that are natural or man-made.

When the panel 16 is in a partially extended position, the vane 26 may rest against a top surface of a vane of the adjacent lower cellular unit 22 at an interface 75, see FIGS. 3A and 4. In this manner, the vanes 26 may form pseudo-cells that provide additional insulation for the panel 16. For example, the vanes 26 may define a cavity 73 created by a temporary seal at interface 75 as the top vane 26 rests on the outer surface of the adjacent lower vane. In some implementations, when the panel 16 is in the extended position, the bottom edge 70 of each vane 26 may be positioned adjacent to or above the first crease 44 of the adjacent lower cellular unit 22 to form a cavity 73 between a lower sidewall of a cellular unit 22, an upper sidewall of an adjacent lower cellular unit 22, and a vane 26 (see FIG. 3A).

With reference to FIG. 3C, each of the primary cells are extended into a fully expanded position as previously described. Each vane 26 generally has a secured portion, referred to as a tab 68, that is attached to a corresponding primary cell 24, and a cantilevered portion 71 that is unattached to the cell 24. The tab 68 of each cell 24 is attached to a cell 24 along a connection region having a predefined width W. For example, adhesive, spatially separated lines of stitching, or any other suitable attachment mechanism may be utilized to connect each vane 26 to a corresponding cell 24. In FIG. 3C, a line of adhesive 78 extends between a top portion or tab 68 of each vane 26 and the upper sidewall portion 42 of each primary cell 24. The line of adhesive 78 attaches each vane 26 to a corresponding cell 24 longitudinally along the length of the cell 24 and laterally along the upper sidewall portion 42 of the cell 24. The lateral connection of the vane 26 to the cell 24, represented in FIG. 3C by a width W, provides a lever effect in which the vane 26 is fixedly attached in a cantilevered or levered relationship to the cell 24. The movement of the cantilevered portion 71 is dependent on and controlled by the movement of the attached top portion or tab 68, which in turn is controlled and/or dependent on the motion of the cell 24 to which it is attached. In other words, the attachment structure of the tab 68 transmits a force or torque, which is generated by the extension of the panel 16, from the cell 24 to the free end 70 of the vane 26.

In operation, as the panel 16 is expanded, the primary cell 24 elongates in a vertical direction, which in turn pulls the first side 41 and the second side 43 inward toward each other, thereby reducing the width or depth of the cell 24. As each vane 26 is connected to an upper sidewall portion 42 of a cell 24 along a connection region having a width W, the attached top portion or tab 68 of each vane 26 moves with the first side 41 in a generally arcuate path as the first side 41 transitions from a partially expanded position to a fully expanded position. Based on the rotation or movement of the top portion or tab 68 along the arcuate path, the cantilevered portion 71 rotates or moves in a clockwise direction about the connection region of the vane 26 to the cell 24. In other words, the generally rotational movement of the connection region creates a torque load on the cantilevered portion 71, which in turn forces, through the body of the vane 26, the bottom edge 70 of the vane 26 against a next adjacent, lower vane 26. Stated yet another way, the movement of the first side 41 creates a moment about the tab 68, which drives the bottom edge 70 of a vane 26 against an outer surface of a lower vane 26 to effect a seal or biased engagement at the interface 75 of the bottom edge 70 of a vane 26 and an adjacent, lower vane 26. In some examples, the seal may be hermetic. In some examples, the seal may not have hermetic qualities. In one example, the seal may constitute an abutting engagement between a bottom end 70 of a vane and an outer surface of an adjacent, lower vane, and the engagement may or may not be sealed against the transmission of gas or liquid through the interface 75.

The force or pressure exerted by the bottom edge 70 of a vane against a lower, adjacent vane, and thus the effectiveness of the seal at the interface 75, may be affected by the width W of the connection region, the rigidity of the vane 26, and/or the curvature of the vane 26. Generally, increasing the width of the adhesive or connection region increases the force or pressure applied at the interface 75. In some examples, the width W is at least ⅛ of an inch. In one particular example, the width W of the connection region is approximately ¼ of an inch. In addition, increasing the rigidity of the vane 26 also may increase the force or pressure applied at the interface 75. For example, the vane 26 may be constructed of relatively stiff materials and/or a plurality of layers. Further, altering the curvature of the vane 26 so that the bottom edge 70 of the vane 70 contacts an outer surface of the next lower vane 26 substantially normal or perpendicular to the outer surface may increase the force or pressure applied at the interface 75, thereby generally increasing the effectiveness of the seal and increasing the R-value of the cellular panel.

As discussed in more detail below with respect to FIGS. 6A-7, the vane 26 also has a gentle sloping curvature. In the extended position of the panel 16, the vanes 26 have a substantially uniform appearance as the sloping curvature of each vane 26 intersects to make the vanes 26 have a continuous and non-divided appearance. In other words, in an extended position the vanes 26 appear to be a single sheet of material flowing or waving over the primary cells 24. The overall shape of the vanes 26 as well as the primary cell 24 is aesthetically pleasing and enhances a visual experience of the user. While certain elements of the cellular structure are functional, the combination of elements and some sub-combinations are also distinctive and provide a unique aesthetic appearance.

When the cellular panel 16 is in the stacked or fully retracted position, the vanes 26 rest on an outer surface of the primary cell 24 and extend outward to be aligned substantially adjacent to the top surface of adjacent vanes. The curvature of the vanes 26 of adjacent cellular units 22 may be aligned so that the stacked panel 16 may have a similar overall curvature. Furthermore, the stacked or retracted height or thickness T1 of the single material side (or first side 41 of the primary cell 24) may be approximately the same as the stacked height or thickness T2 of the second side 43 of the primary cell 24 and the vane 26.

As shown in FIG. 3B, the vane 26 may also balance the thickness T1 of the first side 41 of the primary cell 24 and the vane 26 with the thickness T2 of the second side 43 of the primary cell 24. Thus, the thickness T2 of the multiple creases 48, 50, 52 is balanced against the single crease 44 of the first side 44 by the vane 26. As the thickness T1 and T2 are substantially equal, the cellular panel 16 may more easily stack when retracted, although the depths D1, D2 may not be equal to one another. As the vanes 26 may be only connected along a top portion or tab 68 to a single cellular unit 22 (adjacent the top 30 of each primary cell 24), the vanes 26 may be substantially completely compressed when in the retracted position of the panel 16, as shown in FIGS. 2 and 3B. Referring to FIG. 3B, the adhesive 78 may be laterally separated from the adhesive 60 downwardly and outwardly along the upper sidewall portion 42 of the primary cell 24 so that an upper surface of the vane 26 does not interfere with the position of a lower sidewall portion 61 of an adjacent, upper cell 24. In some examples, the upper surface of the vane 26 is vertically aligned with an upper surface of the adhesive 60 or positioned below the upper surface of the adhesive 60. In this fashion, the vane 26 does not affect the stacking of the cells 24. Additionally or alternatively to the selective lateral positioning of the adhesive 78, the thickness or height of the adhesive 78 may be less than the thickness or height of the adhesive 60 to ensure the vane 26 does not contact a lower sidewall portion 61 of an adjacent, upper cell 24.

Figure 6A:
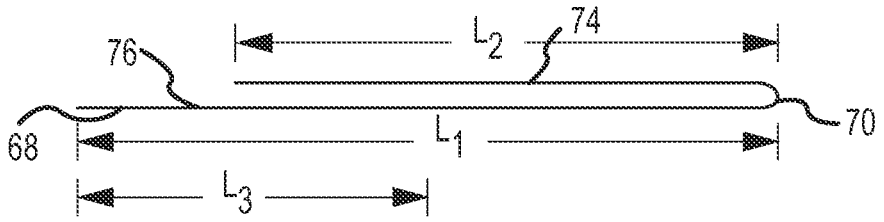
FIG. 6A is a side elevation view of a vane of the cellular unit, prior to the vane being formed.
Figure 6B:
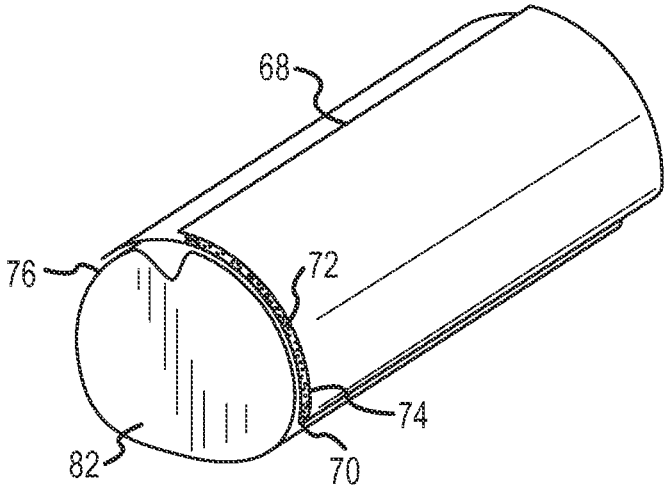
FIG. 6B is an isometric view of the vane being formed on a forming structure.

FIG. 6A is a side elevation view of the vane 26 before being formed. FIG. 6B is an isometric view of the vane 26 being formed. FIG. 7 is a side elevation view of the vane 26 after being formed and prior to be operably connected to the primary cell 24. The vane 26 may be formed from a single piece of material folded over itself, to create multiple material layers. For example, as shown in FIG. 6A, the vane 26 is folded at fold or crease 70 to create a bottom portion 76 and a top portion 74. The top portion 74 of the vane 26 is positioned adjacent a top surface of the bottom portion 76 and the top portion 74 and the bottom portion 76 may be secured together via adhesive 72, or in other manners (e.g., sewing, fasteners, etc.).

The adhesive 72 may be positioned at an edge of the top portion 74 or may be positioned along the entire length L2 of the top portion 74. In some implementations, the adhesive 72 is positioned at the edge of the top portion 74 along substantially the entire length L2 of the top portion 72, but may terminate prior to the fold 70. Near or at the fold 70 the vane 26 may define an opening along its width. In these examples, the fold 70 may form a tear-drop shaped opening between the top portion 74 and the bottom portion 76.

The bottom portion 76 has a length L1 and the top portion 74 has a length L2. The top portion 74 is folded at fold 70 so that the length L2 of the top portion 74 is less than the length L1 of the bottom portion 76. This forms a tab 68 on the bottom portion 76. The tab 68 generally refers to the portion of the vane operably engaged with the primary cell 24. The tab 68 shown in FIGS. 6A-7 is a single layer of material, whereas the length L2 of the top portion 74 is two layers of material (the top portion 74 overlaid on top of the bottom portion 76). It should be noted that in some instances, the strip of material for the vane 26 may include multiple layers of materials and thus the length L2 of the vane 26 may be more than two layers and the tab 68 may be more than a single layer of material. However, the combination of the top portion 74 and the bottom portion 76 may have a material height that may be approximately double the material height of the tab 68.

The tab 68 provides a connection location for operably connecting the vane 26 to the primary cell 24. Referring briefly to FIG. 3A, the tab 68 is secured to the primary cell 24 via adhesive 78 positioned on a front surface of the first side 41 of the primary cell 24. The tab 68 then supports the vane 26 on the primary cell 24.

The vane 26 (via the tab 68) may be connected at the interface between adjacent primary cell 24, or as shown in FIG. 3A may be connected adjacent to the interface along a top outer surface of the first sidewall 42 prior to the crease 44. In some implementations, the only portion of the vane 26 that may be attached to the primary cell 24 may be the tab 68. In these implementations, the vane 26 may be more flexible as the tab 68 is formed of a single layer of material and thus is more flexible than the connected top and bottom portions 74, 76 of the vane 26. This allows the vane 26 to more easily flex upwards when the panel 16 is stacked (see FIG. 3B) and flex downward when the panel 16 is extended.

The tab 68 may also determine the length that the vane 26 may extend outward over the first side 41 of the primary cell 24. By varying the length of the tab 68, the vane 26 may drape closer to or farther away from the first side 41 of the primary cell 24. In some implementations, the length of the top and bottom portions 74, 76 are approximately the same. In these implementations, the bottom portion 76 of the vane 26 may be connected to the primary cell 24.

Referring to FIGS. 6A and 6B, the vane 26 may be placed over a form 82 shaped with the desired curvature of the vane 26. The form 82 may be generally any type of substantially rigid material that may provide a shape over which the vane 26 can be laid and heated, e.g., a metal, plastic, or other material formed in a desired shape. The vane 26 may be laid over the form 82 and then folded at fold 70 and secured with the adhesive 72. As can been seen in the comparison between FIGS. 6A and 6B, prior to be overlaid on the form 82, the vane 26 may be substantially flat and due to the flexibility of the material may trace the shape of the form 82 when overlaid on top of the form 82.

Once the top portion 74 and the bottom portion 76 are secured together, defining the tab 68, the vane 26 and the form 82 may be heated. The heat may allow the adhesive 72 to set, as well as allow for the vane 26 to set around the shape of the form 82. After the vane 26 has cooled it may generally trace the shape of the form 82. In one implementation, the vane 26 may be substantially straight along a length L3 (which extends from the tab 68 to approximately a mid point of the top portion 74). Then at the end of the length L3, the vane 26 may be curved downward. In this implementation, the vane 26 may lie flatter against the first side 41 of the primary cell 24, while still having some curvature that extends downward to provide structure and an aesthetically pleasing appearance.

Figure 7:
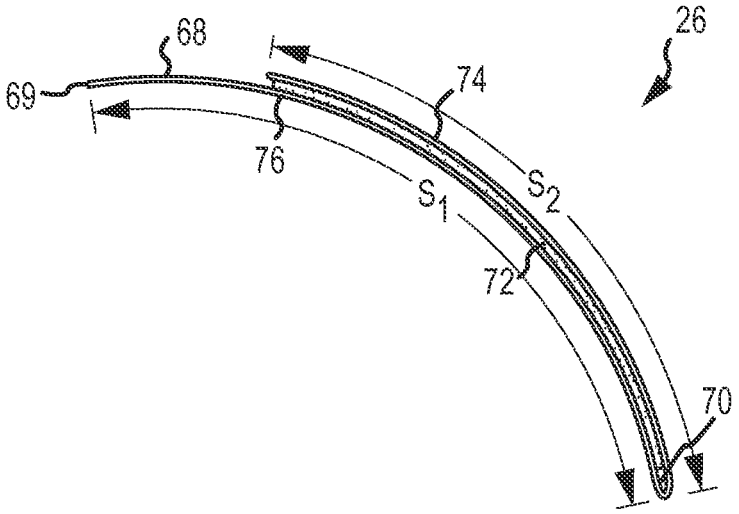
FIG. 7 is a side elevation view of the vane after being formed, but prior to be operably connected to the cellular unit.
Figure 7A:
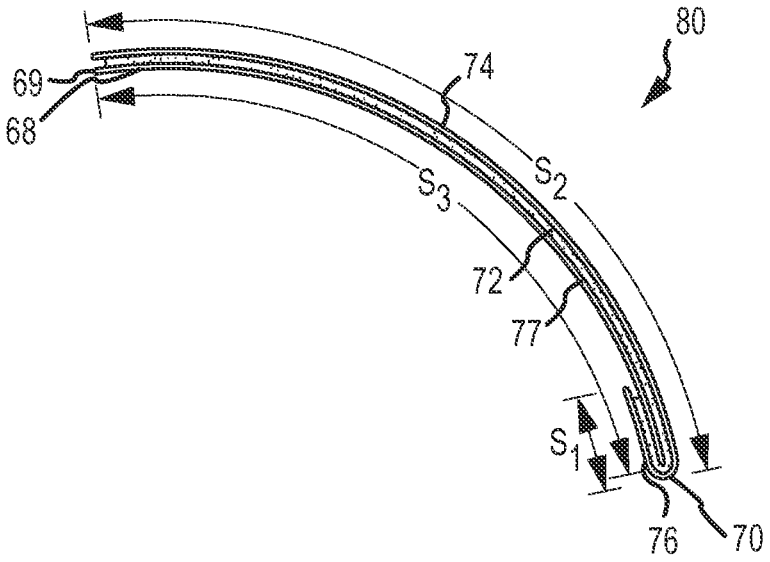
FIG. 7A is a side elevation view of another example vane after being formed, but prior to be operably connected to the cellular unit.
Figure 8:
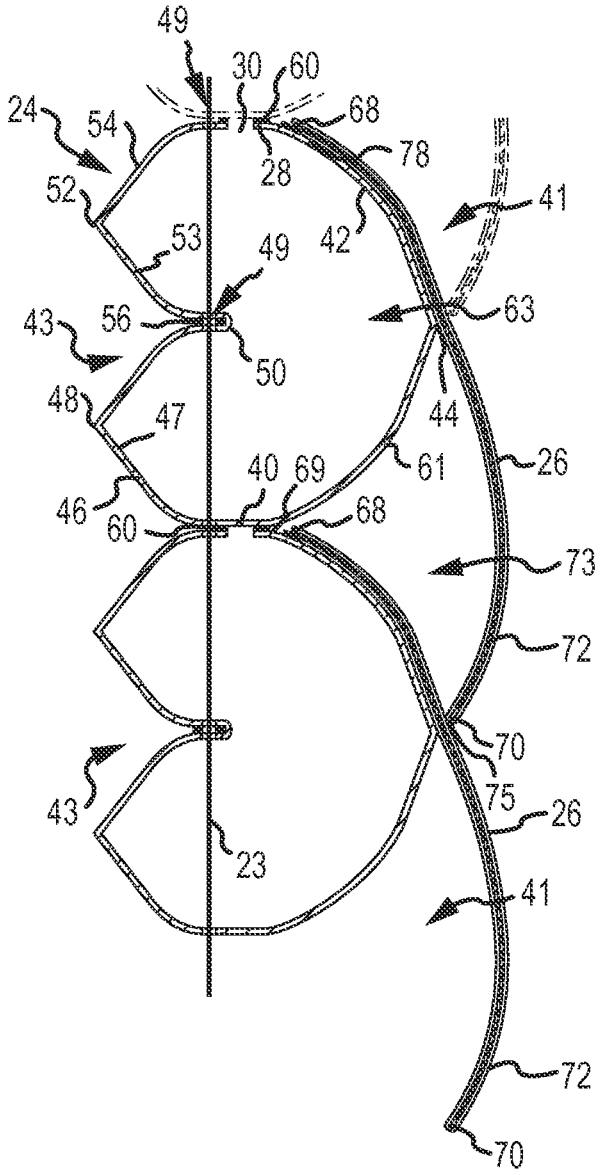
FIG. 8 is an enlarged cross-section view of the cellular unit of FIG. 1 taken along the line 8-8 as shown in FIG. 1.
Figure 9:
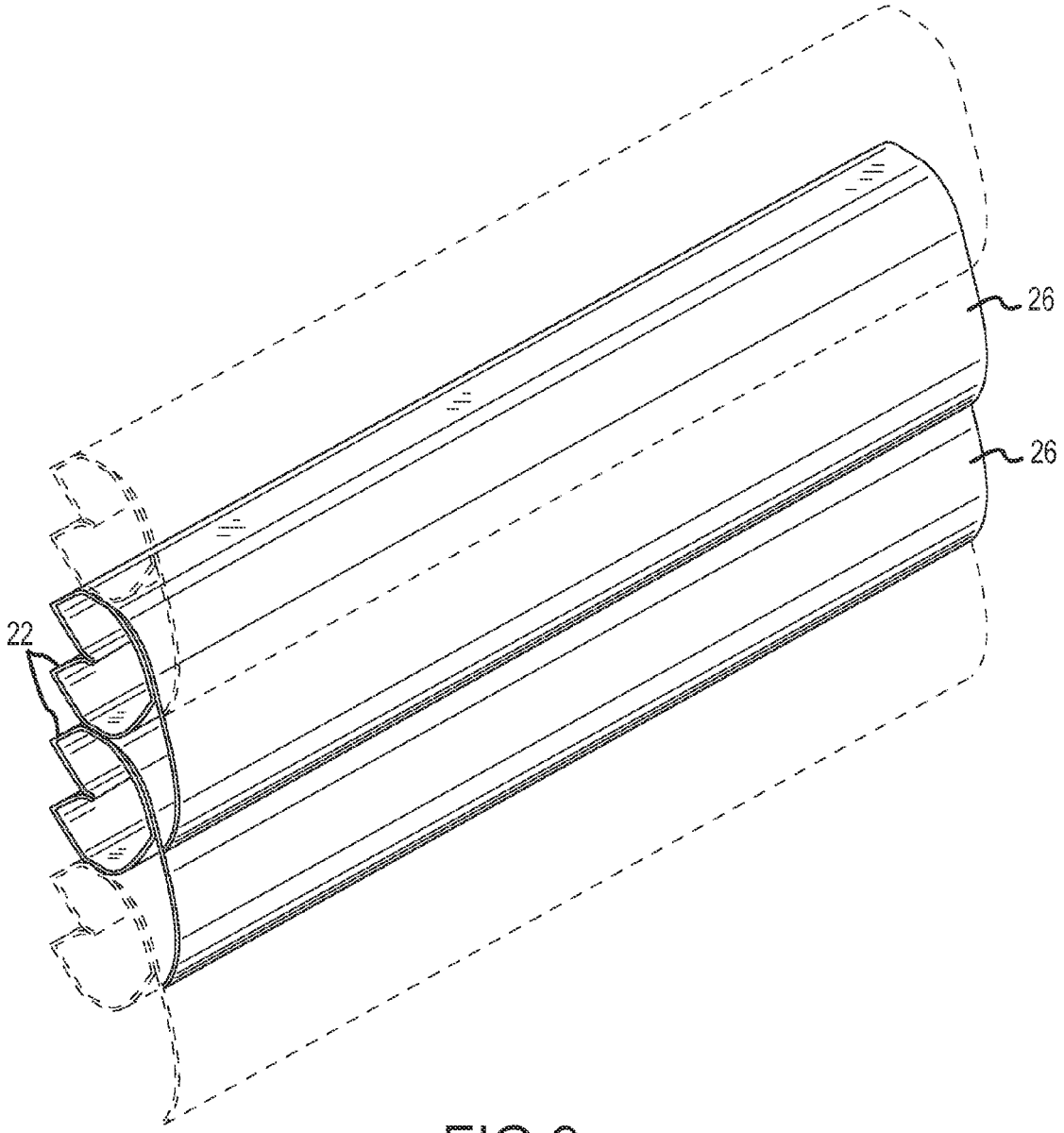
FIG. 9 is an isometric view of two cellular units removed from the panel of FIG. 1.
Figure 10:
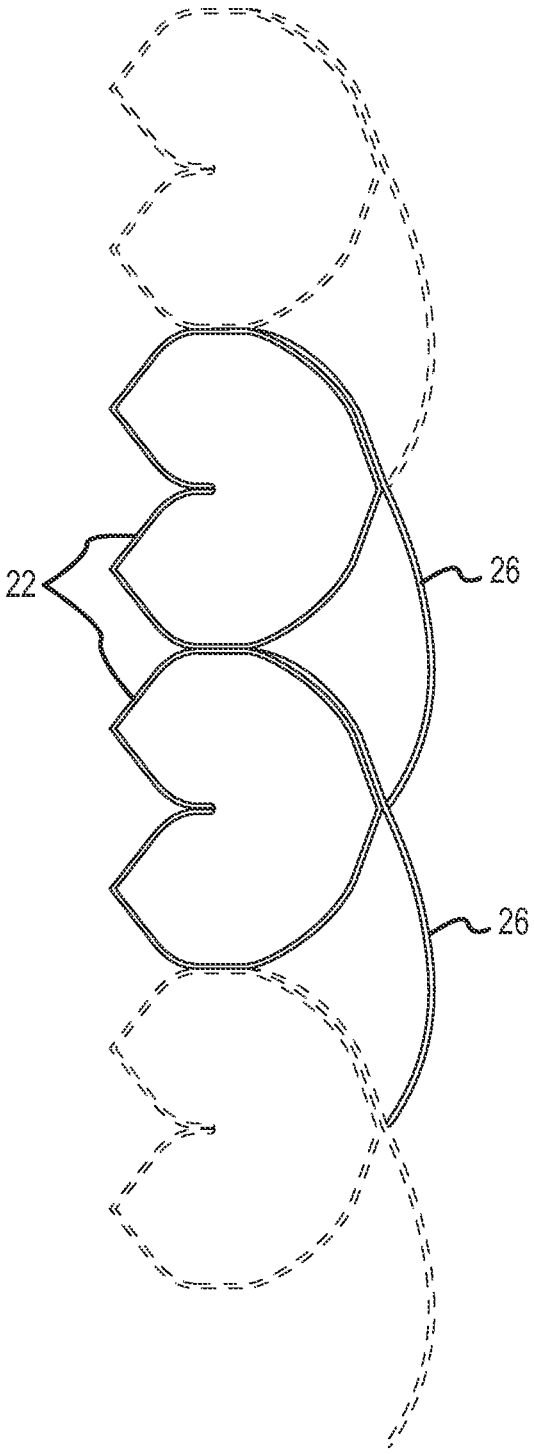
FIG. 10 is a side elevation view of the two cellular units of FIG. 9.
Figure 11:
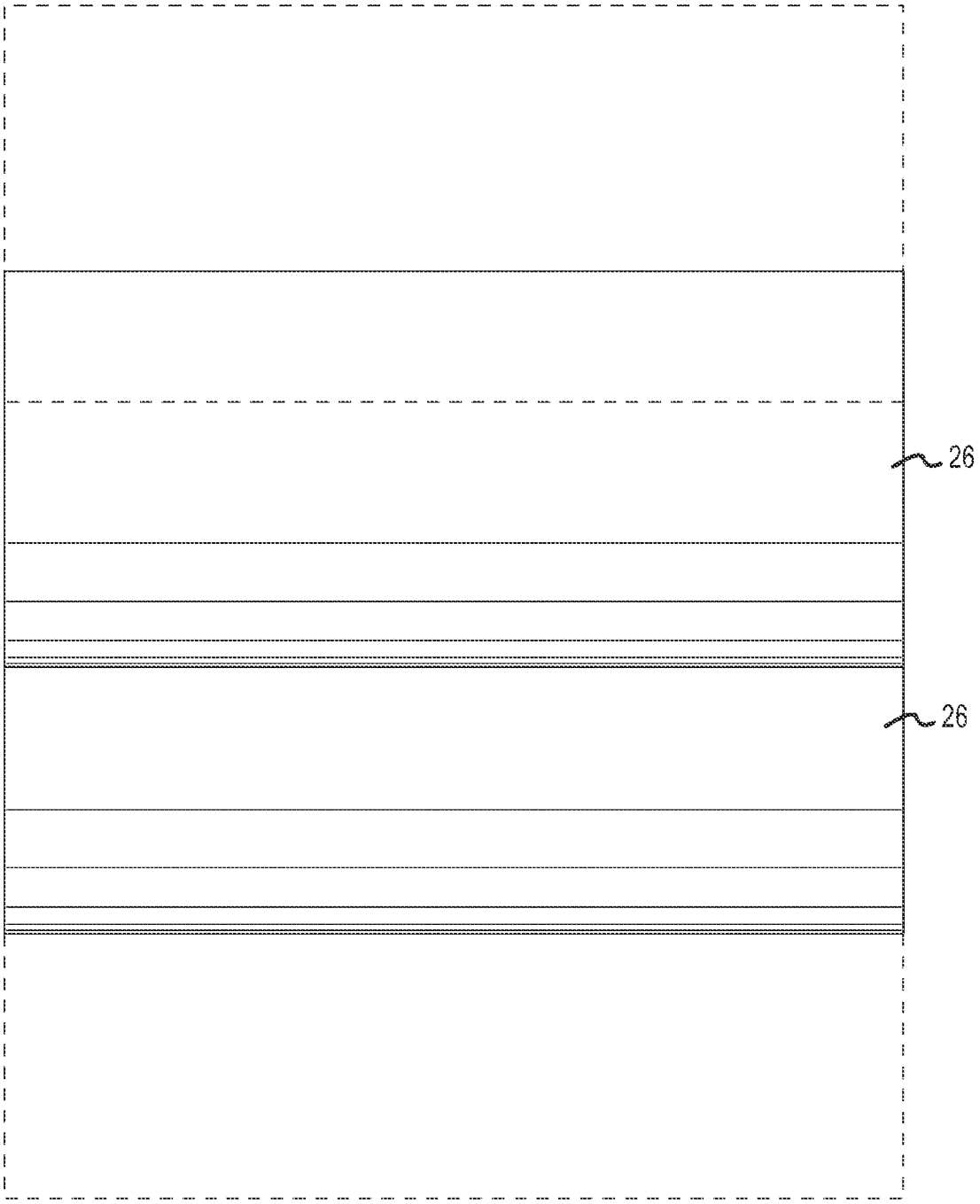
FIG. 11 is a front elevation view of the two cellular units of FIG. 9.
Figure 12:
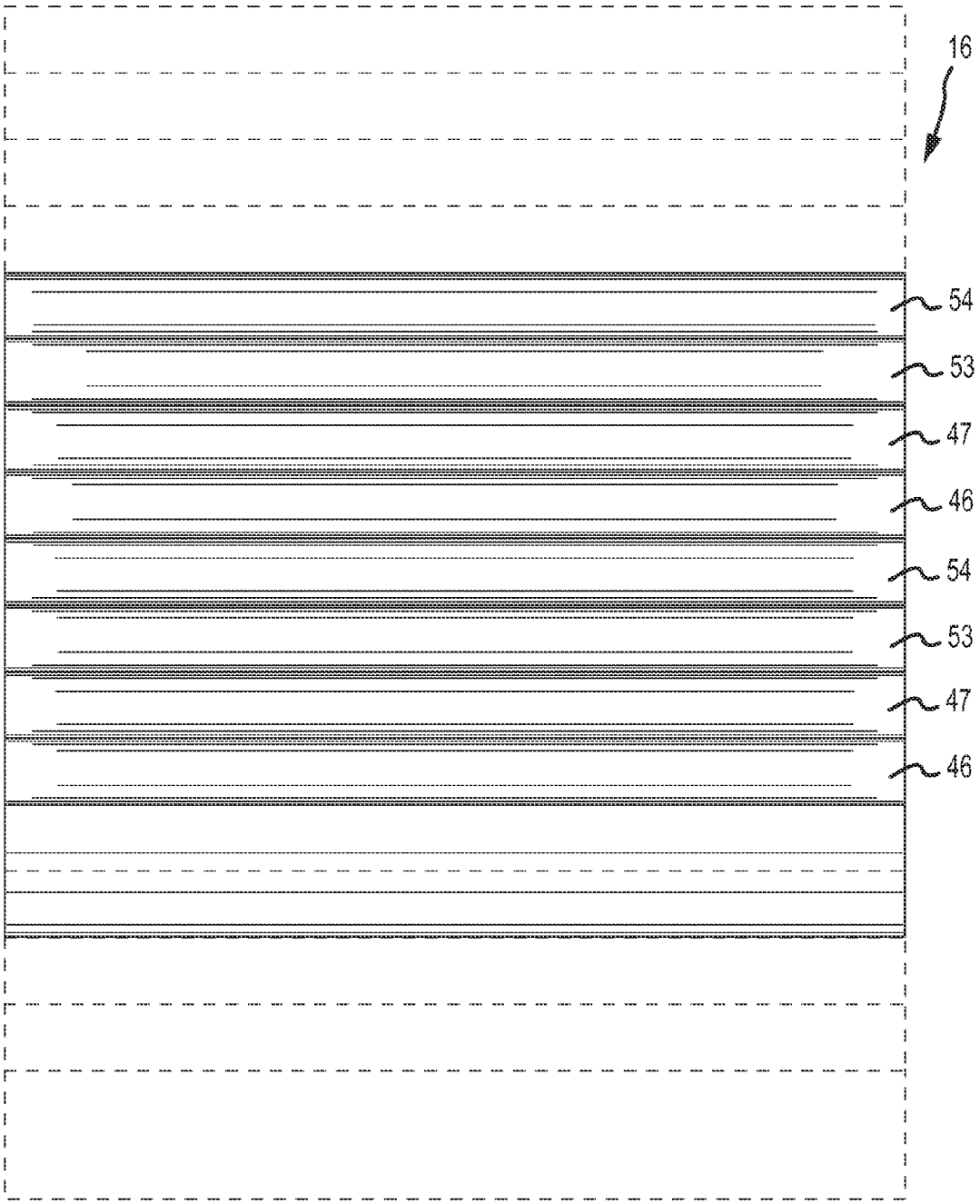
FIG. 12 is a rear elevation view of the two cellular units of FIG. 9.
Figure 13:
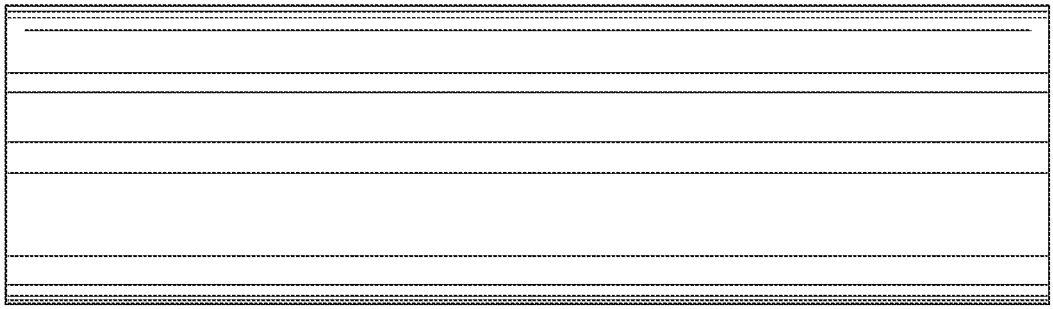
FIG. 13 is a bottom plan view of the two cellular units of FIG. 9.
Figure 14:
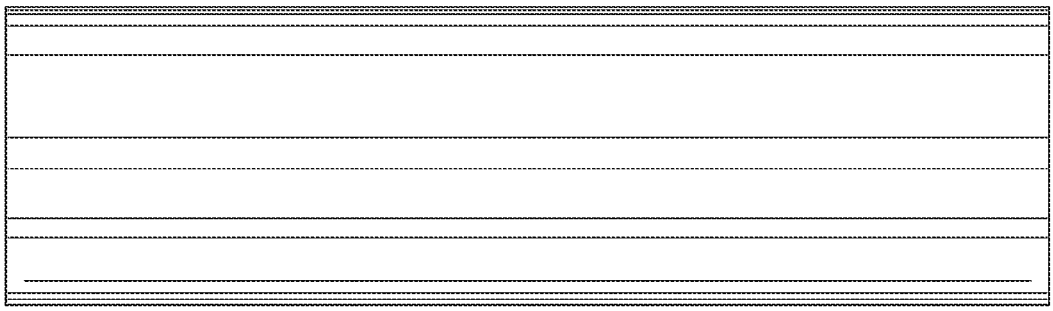
FIG. 14 is a top plan view of the two cellular units of FIG. 9.

Referring now to FIG. 7, after the vane 26 is removed from the form 82, the top portion 74 of the vane 26 may have an arc length of S2 and the tab 68 and the bottom portion 76 of the vane 26 may have an arc length of S1. As the length L1 of the bottom portion 76 and the tab 68 of the vane 26 is longer than the top portion 74 length L2, the arc length S2 of the top portion 74 may be less than the arc length S1 of the bottom portion 76 and the tab 68. FIG. 7A illustrates a side elevation view of another example formed vane prior to be operably connected to the cellular unit. Generally, a vane may be constructed of various materials and/or layers. For example, the vane 80 shown in FIG. 7A includes a moldable plastic component 77 and a fabric layer that covers an outer surface of the plastic component 77. The fabric layer is folded over a bottom edge of the plastic component 77 to form a rounded bottom edge 70 that is slidable along an outer surface of an adjacent, lower vane. The fabric layer substantially prevents the bottom edge 70 of the vane 80 from catching on or sticking to surface irregularities of the outer surface of the adjacent, lower vane. The fabric layer is attached to the plastic component 77 with an adhesive layer 72, although alternative connection mechanisms such as stitching may be utilized. In FIG. 7A, the fabric layer has a top portion 74 with an arc length S2 and a bottom portion 76 with an arc length S1. The arc length S2 is greater than the arc length S1, although alternative configurations may be utilized in which arc length S1 the same as or greater than arc length S2. The component 77 has an arc length S3, which is greater than the arc length S1 but less than the arc length S2. The arc length S3 of the component 77 may vary. In some examples, the fabric layer has a length of approximately five inches. In some examples, the vane is formed with a radius of curvature of approximately three inches.

As shown in FIG. 7A, the tab 68 is constructed of more than a single layer of material. In other words, the tab 68 includes multiple layers, which may increase the amount of force exerted by the bottom edge 70 on an adjacent, lower vane. In particular, in FIG. 7A, the layers of the tab 68 include a plastic component 77, an adhesive layer 72, and a top portion 74 of the fabric. The arc length of the tab 68 generally corresponds with a desired width of the connection region of a vane to a primary cell. As previously discussed, the width of the connection region may vary depending on the amount of force desired at the bottom edge 70 of the vane 26.

Conclusion

The foregoing description has broad application. For example, while examples disclosed herein may focus on the curvature of the vane, it should be appreciated that the concepts disclosed herein may equally apply to generally any curvature of the vane. Similarly, although cellular unit and the vane have been discussed as being formed in a particular manner, the devices and techniques are equally applicable to embodiments using other forming techniques. Accordingly, the discussion of any embodiment is meant only to be explanatory and is not intended to suggest that the scope of the disclosure, including the claims, is limited to these examples.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The drawings are for purposes of illustration only and the dimensions, positions, order and relative sizes reflected in the drawings attached hereto may vary.

What is claimed is:

1. A covering for an architectural opening, comprising:
a cellular panel including at least one cellular unit, each cellular unit comprising:
a primary cell having opposing first and second exterior side walls defining an interior space therebetweeen and including:
the first exterior side wall having a first crease directed outwardly from the interior space; and
the second exterior side wall having a second crease directed inwardly into the interior space; and
a vane connected to an exterior of the first exterior side wall of the primary cell.

2. The covering of claim 1, wherein the vane comprises:
a bottom layer; and
a top layer overlaid on a portion of the bottom layer.

3. The covering of claim 2, wherein the vane further comprises a tab.

4. The covering of claim 3, wherein the tab is secured to the primary cell, and wherein when the primary cell is extended, the tab creates a lever effect in which a bottom edge of the vane imparts a force on an adjacent, lower vane to form a seal between the bottom edge of the vane and the adjacent, lower vane.

5. The covering of claim 1, wherein the second crease is secured via adhesive.

6. The covering of claim 1, wherein the vane is connected via adhesive to an outer top surface of the primary cell.

7. The covering of claim 1, wherein in an extended position the vane creates a pseudo-cell with an adjacent vane.

8. The covering of claim 1, wherein the second exterior side wall further includes a third crease and a fourth crease.

9. The covering of claim 1, wherein the vane is connected to a surface of the first exterior side wall of the primary cell, the surface facing outwardly from the interior space.

10. The covering of claim 8, wherein the third and fourth creases are directed outwardly from the interior space of the primary cell.

11. A covering for an architectural opening, comprising:
a head rail;
an end rail; and
a cellular panel operably connected between the head rail and the end rail, the cellular panel including a first cellular unit and a second cellular unit vertically aligned, the first cellular unit positioned above and immediately adjacent to the second cellular unit, each cellular unit comprising:
a cell including a first side, a second side, a top, and a bottom, the first side of the cell having a crease, an upper sidewall extending between the top of the cell and the crease, and a lower sidewall extending between the bottom of the cell and the crease; and
a vane connected to the upper sidewall of the first side of the cell, the vane having a bottom edge extending below the crease of the first side of the cell;
wherein, when the cellular panel is in an extended position, the bottom edge of the vane of the first cellular unit abuts against the vane of the second cellular unit adjacent to or above the crease of the second cellular unit to form a cavity between the lower sidewall of the first cellular unit, the upper sidewall of the second cellular unit, and the vane of the first cellular unit.

12. The covering of claim 11, wherein the upper sidewall and the lower sidewall of the first side of each cellular unit is arcuate.

13. The covering of claim 11, wherein the vane of each cellular unit has a top edge positioned adjacent to the top of the cell.

14. The covering of claim 11, wherein the vane of the first cellular unit is supported by the vane of the second cellular unit.

15. The covering of claim 11, wherein the vane of the first cellular unit abuts the vane of the second cellular unit at the crease of the second cellular unit.

16. The covering of claim 11, wherein:

the vane of the first cellular unit is supported along the upper sidewall to the crease of the first cellular unit; and the vane extends away from the crease of the first cellular unit in a downwardly direction and is supported by the vane of the second cellular unit.

17. The covering of claim 16, wherein the vane of the first cellular unit is supported at the crease of the second cellular unit.

18. A covering for an architectural opening, comprising:

a head rail;

an end rail; and a cellular panel operably connected between the head rail and the end rail, the cellular panel including at least one cellular unit, each cellular unit comprising:

a primary cell having opposing first and second exterior side walls defining an interior space therebetween and including:

the first exterior side wall having a first crease directed outwardly from the interior space; and the second exterior side wall having a second crease directed inwardly into the interior space; and a vane operably connected to an exterior of the first exterior side wall of the primary cell.

19. The covering of claim 18, wherein the vane has a tab that is adhesively secured to the primary cell.

20. The covering of claim 18, wherein the vane is connected via adhesive to an outer top surface of the primary cell.

21. The covering of claim 18, wherein in an extended position the vane creates a pseudo-cell with an adjacent vane.

22. The covering of claim 18, wherein the vane has a bottom edge that is positioned below the first crease of the first exterior side wall of the primary cell.

* * * * *